US010370189B2

(12) United States Patent
Thoma et al.

(10) Patent No.: US 10,370,189 B2
(45) **Date of Patent: *Aug. 6, 2019**

(54) TRASH COLLECTOR

(71) Applicant: ROTHO KUNSTSTOFF AG, Wurenlingen (CH)

(72) Inventors: Christian Thoma, Albbruck (DE); Bruno Meier, Untersiggenthal (CH)

(73) Assignee: ROTHO KUNSTSTOFF AG, Wurenlingen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/190,590

(22) Filed: Nov. 14, 2018

(65) Prior Publication Data

US 2019/0077594 A1 Mar. 14, 2019

Related U.S. Application Data

(63) Continuation of application No. 14/971,068, filed on Dec. 16, 2015.

(30) Foreign Application Priority Data

Jan. 8, 2015 (EP) ..... 15150519

(51) Int. Cl.
*B65F 1/16* (2006.01)
*B65F 1/06* (2006.01)

(52) U.S. Cl.
CPC ..... *B65F 1/163* (2013.01); *B65F 1/06* (2013.01); *B65F 1/1646* (2013.01); *B65F 2001/1661* (2013.01); *B65F 2001/1669* (2013.01)

(58) Field of Classification Search
None
See application file for complete search history.

(56) References Cited

U.S. PATENT DOCUMENTS

| | | | |
|---|---|---|---|
| 6,837,393 | B1 | 1/2005 | Kuo |
| 8,028,854 | B2 | 10/2011 | Sofy et al. |
| 2004/0004080 | A1 | 1/2004 | Yang et al. |
| 2005/0017006 | A1 | 1/2005 | Kuo |
| 2005/0284870 | A1 | 12/2005 | Yang et al. |
| 2010/0044380 | A1 | 2/2010 | Nallakrishanan |

FOREIGN PATENT DOCUMENTS

| | | | |
|---|---|---|---|
| CN | 201161800 | Y | 12/2008 |
| CN | 202609427 | U | 12/2012 |
| CN | 202729033 | U | 2/2013 |
| DE | 20305521 | U1 | 7/2009 |
| TW | M240433 | U | 8/2004 |

*Primary Examiner* — Andrew T Kirsch
*Assistant Examiner* — Don M Anderson
(74) *Attorney, Agent, or Firm* — Volpe and Koenig, P.C.

(57) ABSTRACT

A trash collector, including a bucket 1 and a lid 4, which covers the bucket and is fastened pivotally in the area of an upper brim of the bucket, in order to pivot it upwards to open the trash collector. A pedal arrangement 3, 20 is arranged in the area of a base of the bucket, and a lever arrangement 8, 12 connects the pedal arrangement to the lid in order to pivot open the lid by a motion of the pedal arrangement. The lid is embodied in several parts and has at least two lid sections 5, which are each pivotable about as separate axis 30, 30', and a frame element 6, which is provided detachably and/or pivotally in the area of the upper brim of the bucket and to which the lid sections 5 are fastened in a pivotal fashion.

10 Claims, 8 Drawing Sheets

TRASH COLLECTOR

INCORPORATION BY REFERENCE

The following documents are incorporated herein by reference as if fully set forth: U.S. patent application Ser. No. 14/971,068, filed Dec. 16, 2015; and European Patent Application No. EP 15 150 519.5, filed Jan. 8, 2015.

BACKGROUND

The present invention relates to a trash collector. Such a trash collector comprises a bucket and a lid as well as a pedal arrangement and a lever arrangement. The lid covers the bucket and is fastened in a pivotal fashion in the area of the upper brim of the bucket in order to pivot it upwards to open the trash collector. The pedal arrangement is arranged near the bottom of the bucket and is connected via the lever arrangement to the lid, in order to pivot the lid by a motion of the pedal arrangement.

Trash collectors of this type have been known for quite some time in various embodiments. By stepping onto the pedal the lid is pivoted upwards via the lever arrangement in order to open the trash collector. Upon release of the pedal the lid flips downwards automatically, usually due to gravity, so that the bucket of the trash collector receiving the refuse is covered again and thus the trash collector is closed once more.

Commonly such a trash collector exhibits a cover to which the pedal arrangement, the lever arrangement, and the lid are fastened, and which receives a bucket, that can be separately removed. In order to discard the refuse, the bucket can therefore be separated from the cover, the lid, and particularly the pedal arrangement and the lever arrangement.

Trash collectors of the prior art with a lid, pivotal upon a pedal being pressed, have the problem that with increasing volume of the trash collector and accordingly increasing lid area the lid becomes heavier and heavier and thus the lever arrangement must transfer appropriately large forces. This results in respective requirements for the stability of the pedal arrangement, the lever arrangement, and the bearings for the movable parts thereof.

In order to avoid this problem, it is known for example from DE 203 05 521 U1 to provide a trash collector of the type mentioned at the outset with a multi-part lid, which exhibits two lid sections, each of which pivotal about a separate axis. The lever arrangement essentially comprises two push rods, which are jointly fastened to a pedal arrangement and mounted with their upper ends in an articulate fashion to the lid sections such that these are pivoted upwards upon operation of the pedal. Here, each lid section is pivoted upwards and to the side about a separate pivotal axis in order to release the opening of the bucket.

The two lid sections of the trash collector according to prior art are fastened pivotally to the upper brim of an encasement, which receives the lever arrangement and a bucket, which can be separately removed, as well as the pedal arrangement. When the lid sections are completely opened, the separate bucket can be removed in order to discard the collected trash. Due to the fact that here it is necessary to pivot the two lid sections by at least 90°, so that the horizontal projection area of the bucket is completely released, return springs are provided within the lever arrangement, which ensure that the lid sections automatically and independent from gravity fold shut when the pedal is not actuated. This return motion must be braked by a damper element, in order to cushion the spring forces of the return springs, acting in addition to gravity.

For reasons of cost efficiency it is however not advantageous to embody the trash collector with a double wall, thus providing an encasement, which receives a separately removable bucket, particularly since in a large volume trash collector the bucket generally must be lined by the user with a trash bag, which can be removed from the bucket for discarding the collected trash. In particular in case of a cost-effective production of the trash collector from plastic, particularly preferred within the scope of the present invention, the double-walled embodiment leads to significantly higher material costs as well as the need for a separate production of the individual parts, with corresponding higher expenses.

SUMMARY

The present invention is therefore based on the objective to further develop a trash collector of the type mentioned at the outset such that a separately removable bucket can be omitted.

This objective is attained in a trash collector having one or more features of the invention. Preferred embodiments and further developments of the trash collector according to the invention are described below and in the claims.

The trash collector embodied according to the present invention is therefore provided with a modified lid, which in addition to at least two lid sections comprises a frame element, which is fastened in a detachable and/or pivotal fashion in the area of the upper brim of the bucket, and with the lid sections being pivotally fastened thereon.

By this modification of the lid, the lid sections can be pivoted or removed completely from the upper brim of the bucket so that the horizontal projection area of the bucket is then also completely released, when no separately removable bucket is provided. Additionally, within the scope of the present invention it is also possible to provide the trash collector with a separately removable bucket and an encasement that receives it. In any case, the lid sections with their hinges can be pivoted off and/or removed with their hinges from the upper brim of the bucket so that the handling of a trash bag and/or the removal of a separately removable bucket is not hindered even if the lid sections can be pivoted open by angles that are slightly less than 90 degrees, so that gravity ensures for an automatic folding shut of the lid sections without requiring any return mechanism.

Preferably the lever arrangement of the trash collector according to the invention comprises a distribution element for distributing a motion of the pedal arrangement to the individual lid sections, with the distribution element for each lid section having a support arm, extending upwards, and including a bearing site, open towards the top, for receiving a support element of the lid section.

The distribution element allows that the lever arrangement not necessarily requires separate push rods for each lid section, arranged at the pedal arrangement with the appropriate space needed. Such a space is normally only available between a separately removable bucket and a cover, so that the distribution element additionally contributes that the trash collector according to the invention requires no separately removable bucket.

The support arms of the distribution element are equipped with bearing sites, open towards the top, in order to allow that the support elements of the lid sections received in the bearing sites, together with the frame element according to the invention, can be lifted upwards or pivoted away without requiring that the support arms are entrained in a motion not provided for them. According to this preferred embodiment of the present invention therefore the support elements of the lid sections and the support arms can easily be separated from each other in order to allow removing and/or pivoting open the frame element together with the lid sections carried thereby.

Here it is particularly preferred for the bearing sites of the support arms and/or the support elements of the lid sections to be provided with control areas, along which the support arms and the support elements can be moved in reference to each other. This occurs during the pivoting of the lid sections, because here a circular motion of the support element coincides with a linear motion of the support arm. In an articulate arrangement, as common in prior art, the support arm had to be mobile in the literal direction like a con rod. The preferred further development of the present invention with control areas at the bearing sites and/or at the support elements allows therefore to embody the support arms in a stiff and only vertically mobile fashion, which simplifies both the guidance of the support arms, the distribution element, and the entire lever arrangement, and also renders the connection between the lever arrangement and the pedal arrangement less expensive.

Here, a further preferred embodiment of the trash collector according to the invention shows a shape of at least one of the control areas preferably provided such that the corresponding lid section pivots open and/or shut at a minor time lag in reference to the other lid sections and/or in reference to the other lid section. This ensures that the edges of the lid sections during the shutting process cannot contact each other and that when pivoting open as well as shutting better pressure compensation occurs between the interior of the trash collector and the environment.

As known per se, it is beneficial within the scope of the present invention that the lever arrangement and/or the pedal arrangement and/or the lid are provided with a damper element, in order to cushion the shutting motion of the lid and/or any shutting motion of the lid sections.

Particularly preferred, the lid of the trash collector according to the invention comprises essentially a frame element and two lid sections pivotally fastened thereto, with the distribution element essentially being formed by a lateral brace and two cantilevers extending therefrom upwards, provided with bearing sites open towards the top for pivoting open the lid sections. This allows a particularly simple design, yet simultaneously stable construction of the lever arrangement.

Preferably, here the distribution element is arranged in a rear upper section of the trash collector, with it being effectively connected via a central push rod to the pedal arrangement. These central push rods may also be fastened to a trash collector, with its bucket simultaneously forming the exterior casing of the trash collector, which therefore is not equipped with a separately removable bucket and a then appropriately necessary encasement, particularly since in this preferred embodiment of the distribution element and the preferred loose support of the lid sections on the support arms both the push rod as well as the distribution element only need to be held movable in the vertical direction.

According to another preferred embodiment of the present invention the distribution element of the lever arrangement is provided with a locking device, which locks the support arms in a raised position in order to prevent the shutting of the trash collector. This way, work including the repeated tossing of trash into the bucket, such as when preparing food, can be performed with an open trash collector, without this requiring that the pedal is permanently activated. This also facilitates the removal of for example a trash bag used inside the trash collector for discarding the entire refuse collected, with however the pivoting open or removal of the frame element including the lid sections fastened thereto, possible according to the invention, representing the preferred method for providing access to the content of the bucket.

To the extent the distribution element is arranged in the rear upper section of the trash collector, it is preferred for the locking mechanism to comprise a handle and a hook element at the lateral brace of the distribution element, whereby the hook element can be suspended in a counter support at a rear of the trash collector and can be unhooked therefrom. The handle is preferably accessible as soon as the lid sections are pivoted open so that then the hook element can be suspended in the counter support, in order to prevent the lid sections from shutting by the support arms remaining in their raised position. Here, the hook element can be suspended in the counter support and disconnected therefrom by tipping the distribution element. When the trash collector according to the invention, which is preferred here, is made essentially from plastic the distribution element is generally elastically deformable to a slight extent so that the suspension and the disconnection of the hook element as well as particularly any tipping of the distribution element can be performed without any additional constructive expense, merely by a slight elastic deformation.

In order to ensure in any case that even lid sections pivoted completely open can automatically shut without any return mechanism, merely based on gravity when the pedal is not activated, it is preferred that in the area of the pivotal support of the lid sections, at the frame element and/or at an upper brim of the bucket, spring-elastic stop elements are provided in order to pivot open lid sections, when the pedal is not activated, to such an extent until they automatically shut due to gravity. Such spring-elastic stop elements then also allow pivoting of the lid sections by an angle of up to 90 degrees or more without here requiring that a return mechanism be provided.

When the bucket of the trash collector according to the invention, as possible by the present invention, simultaneously forms the exterior casing of the trash collector, thus no additional encasement being provided, the bucket is provided at its upper brim preferably with a circumferential collar and the frame element is preferably embodied as an annual fitting which rests on the collar of the bucket. The embodiment of the frame element as an annular fitting ensures a clean upper section of the bucket and offers space at its rear section for the lifting mechanism of the lid sections.

The preferably provided central push rod, connected to a distribution element comprising a lateral brace and two support arms, extends in this case preferably in a groove at a rear exterior of the bucket and is guided via a passage in the area of the upper brim of the bucket into said bucket, with the lateral brace of the distribution element being fastened at the push rod. This fastening may be selected with such stability that the distribution element is indirectly guided at the passage via the push rod which is generally made from metal, and thus it requires no additional guidance. Simultaneously the frame element is preferably provided with a flare extending into the interior of the bucket, which at least convers the lateral brace of the distribution element towards the inside so that the lever arrangement is neither visible to the user nor is there any risk that trash tossed into the trash collector comes into contact with the lever arrangement. Additionally, any contact of a trash bag inserted into the bucket with moving parts of the lever arrangement is excluded thereby. The frame element is here provided with openings for the support arms of the distribution element so that they are guided from the interior of the bucket back to the outside and can contact the lid sections.

Finally, it is preferred within the scope of the present invention that in the area of the upper brim of the bucket, inside the trash collector, removable spring bars are inserted for fixing the trash bag. They may also prevent any slippage of the trash bag into the interior of the bucket when the trash bag, as regularly the case for relatively large-volume trash collectors, is filled with a relatively heavy content. The spring bars may here be fastened at the upper brim of the bucket, particularly when it simultaneously forms the exterior casing of the trash collector. However, they may also be fastened outside the bucket, for example at the upper brim of a cover or at the frame element.

BRIEF DESCRIPTION OF THE DRAWINGS

In the following an exemplary embodiment for a trash collector designed according to the invention is explained in greater detail based on the attached drawings. Shown are.

DETAILED DESCRIPTION OF THE PREFERRED EMBODIMENTS

Figure 1:
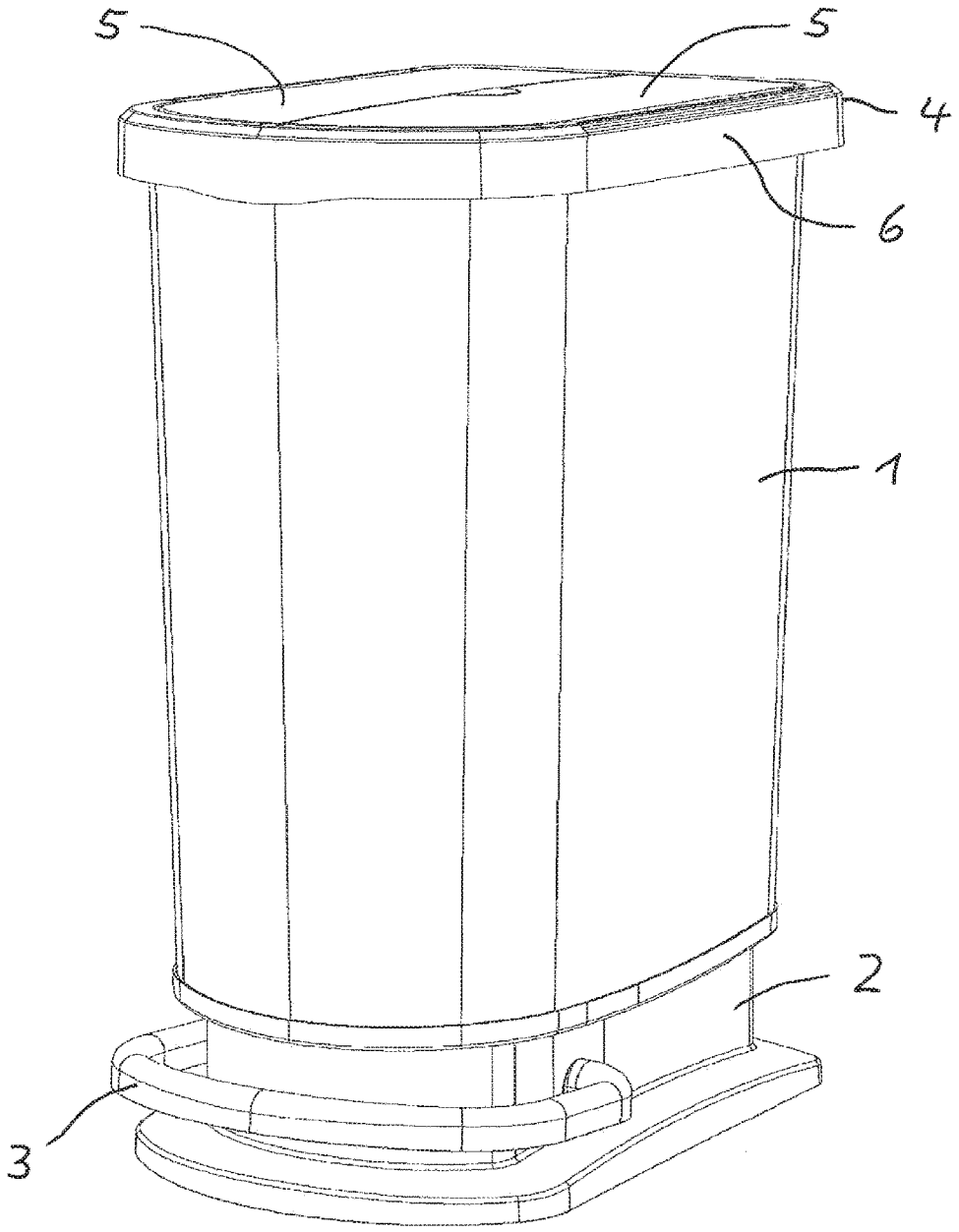
FIG. 1 an overall view of a trash collector embodied according to the invention in the closed state.
Figure 2:
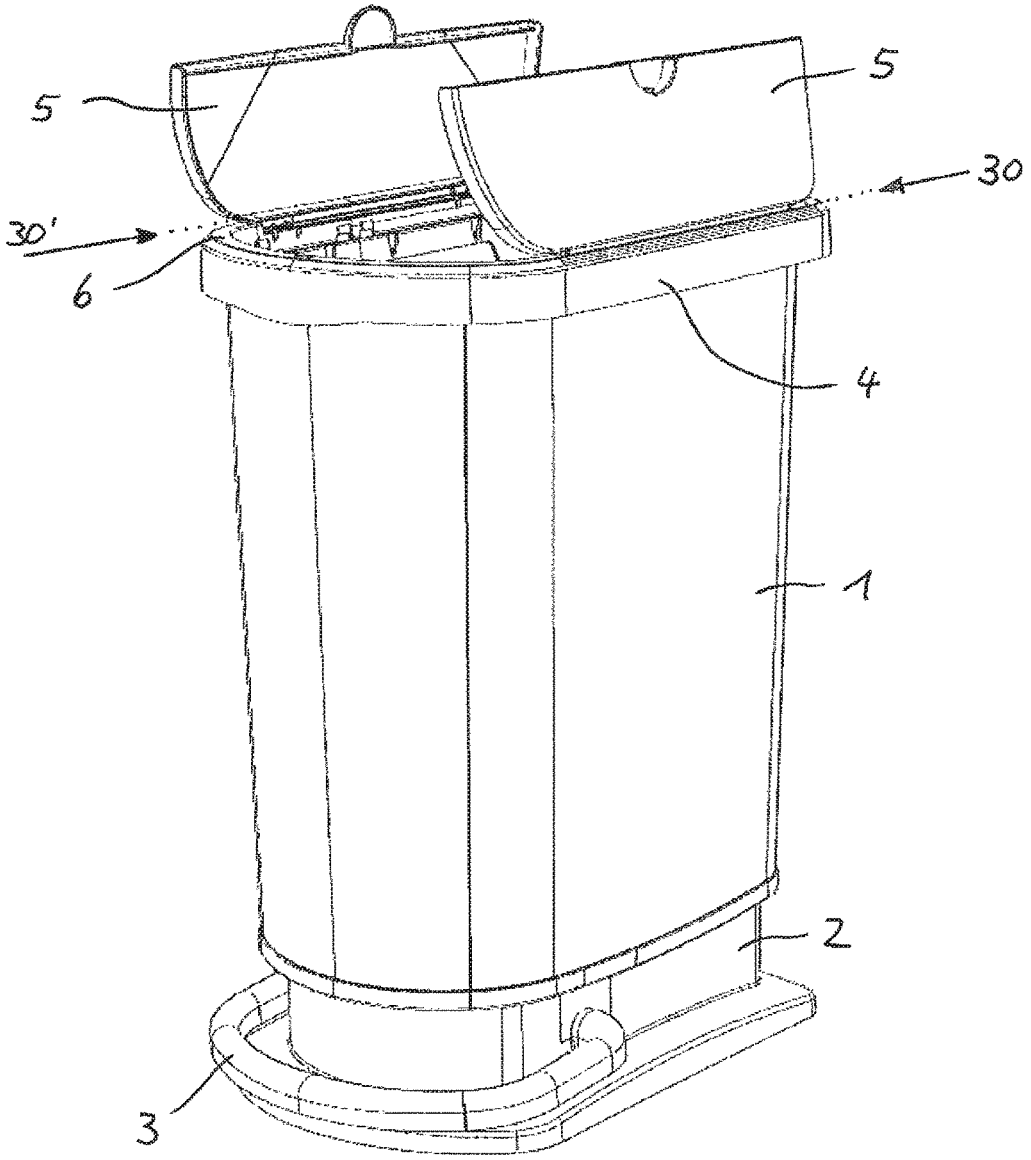
FIG. 2 a view like in FIG. 1, however with the lid opened for use.
Figure 3:
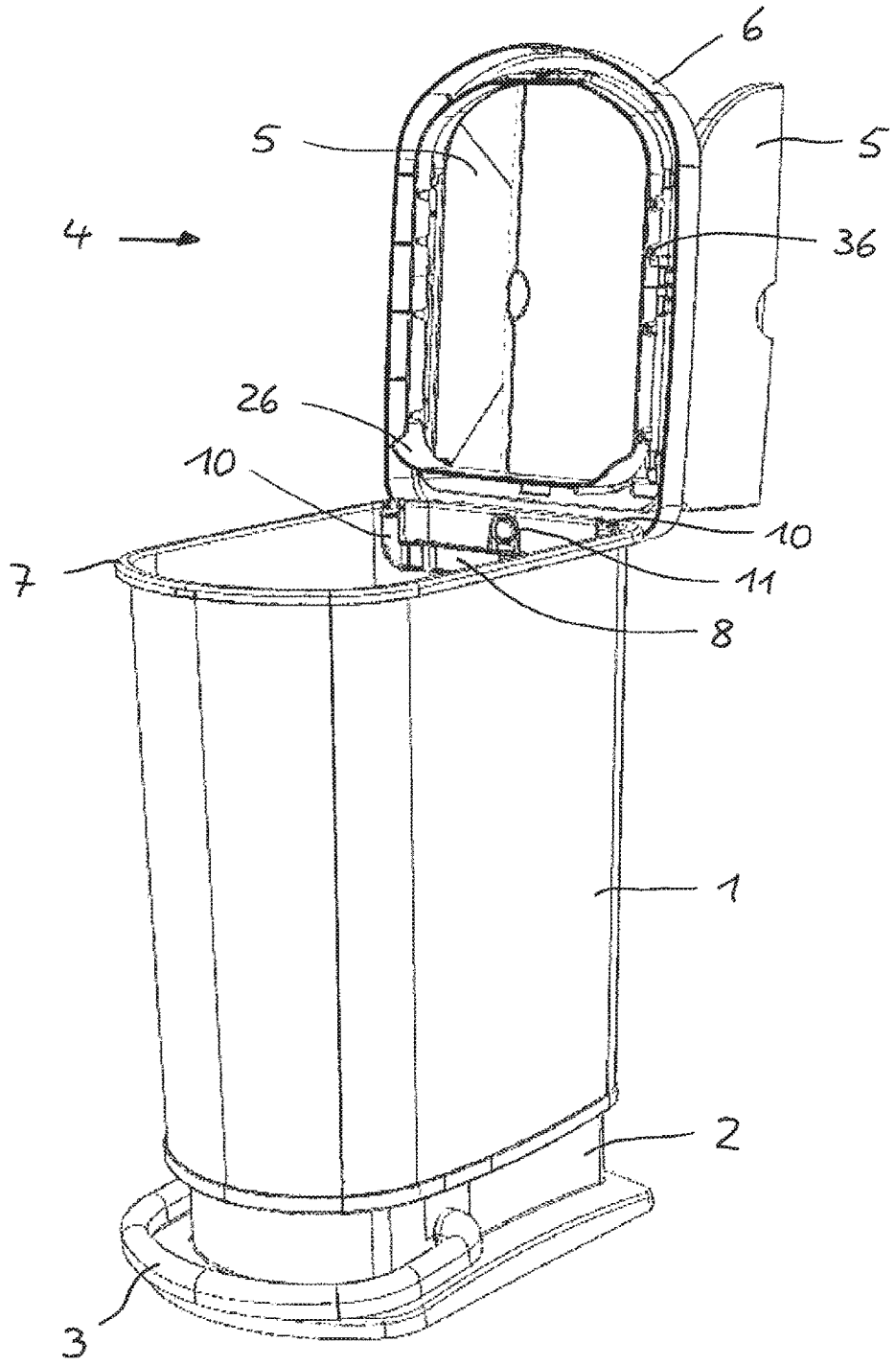
FIG. 3 a view like in FIGS. 1 and 2, however with a completely opened lid.

The trash collector shown in FIGS. 1 to 3 in a closed state (FIG. 1), opened state (FIG. 2), and/or completely opened state (FIG. 3) in a comprehensive view comprises a bucket 1, which simultaneously forms the exterior casing of the trash collector, a base part 2 with a pedal 3, as well as a lid 4, having two lid sections 5, which cover the bucket 1 and are fastened in a pivotal fashion to a frame element 6 formed as an annular fitting.

FIG. 1 shows the trash collector in the completely closed state. The frame element 6 rests on the upper brim of the bucket 1 and the lid sections 5 are closed, so that these three components forming the lid 4 completely cover the top of the bucket 1 in its entirety.

By actuating the pedal 3 the lid sections 5 are pivoted open, as illustrated in FIG. 2. Each of the two lid sections 5 is fastened to the frame element 6, pivotal by a separate hinge, with the pivotal axes 30, 30' about which the two lid sections 5 are pivoted open, that are arranged parallel, however they are not identical. Each of the two lid sections 5 comprises an area, which is approximately equivalent to half the lid area so that the lid sections 5 can appropriately easily be pivoted open by activating the pedal 3; due to the short extension of the lid sections the lever action, which amplifies both the weight force as well as the air resistance of the lid sections 5, is advantageously limited.

In addition to the normal opening of the trash collector by a pressed pedal, as shown in FIG. 2, the entire lid 4 can be pivoted away from the upper brim of the bucket 1. This is illustrated in FIG. 3: Here, the frame element 6, which in the closed state rests on a circumferential collar 7 at the upper brim of the bucket 1, can pivot away towards the rear at a hinge fastened at the upper rear brim of the bucket 1. Due to the fact that the two lid sections 5 are fastened to the frame element 6, they are pivoted away together with the frame element 6 so that the upper brim of the bucket 1 is completely released.

This way, a distribution element 8 is also visible with a lateral brace 9 and two support arms 10 as well as a handle 11, resting on a push rod 12. This is described in greater detail in the following.

Figure 4:
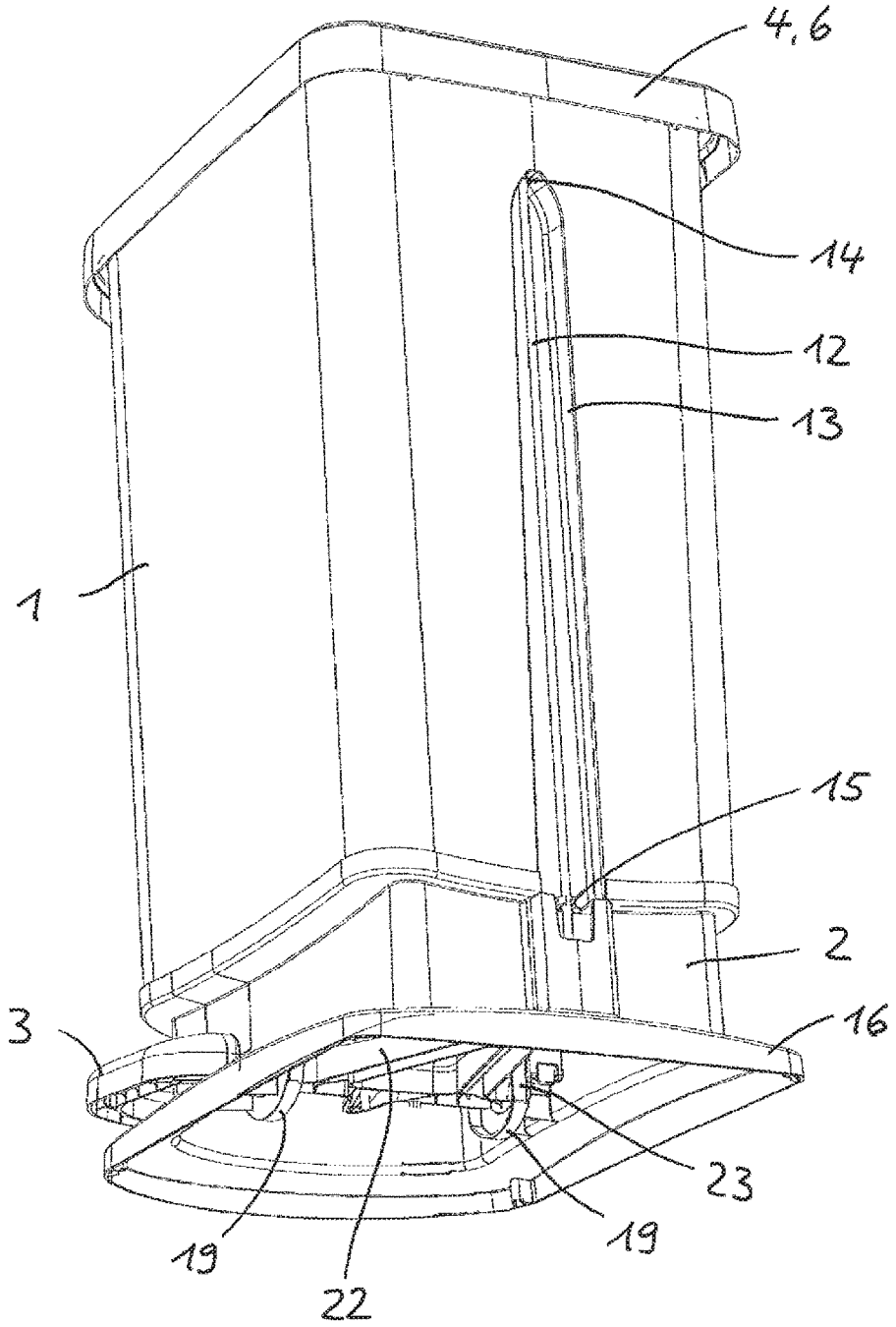
FIG. 4 a view of the trash collector of FIG. 1 in perspective from the bottom.

As discernible from FIG. 4, the push rod 12 is arranged at the rear of the bucket 1 in a groove 13 at a rear exterior of the bucket 1 and guided, on the one side, in a guiding clip 15 at the base part 2, and on the other side, in a penetration 14 in the area of the upper brim of the bucket 1 so that upon activating the pedal 3, effectively connected to the push rod 12, it can be vertically moved. A vertical upwards motion leads to the distribution element 8, fastened on the push rod 12, moving upwards and the support arms 10 being propelled upwards in order to pivot open the lid sections 5 (FIGS. 3, 2).

Figure 5:
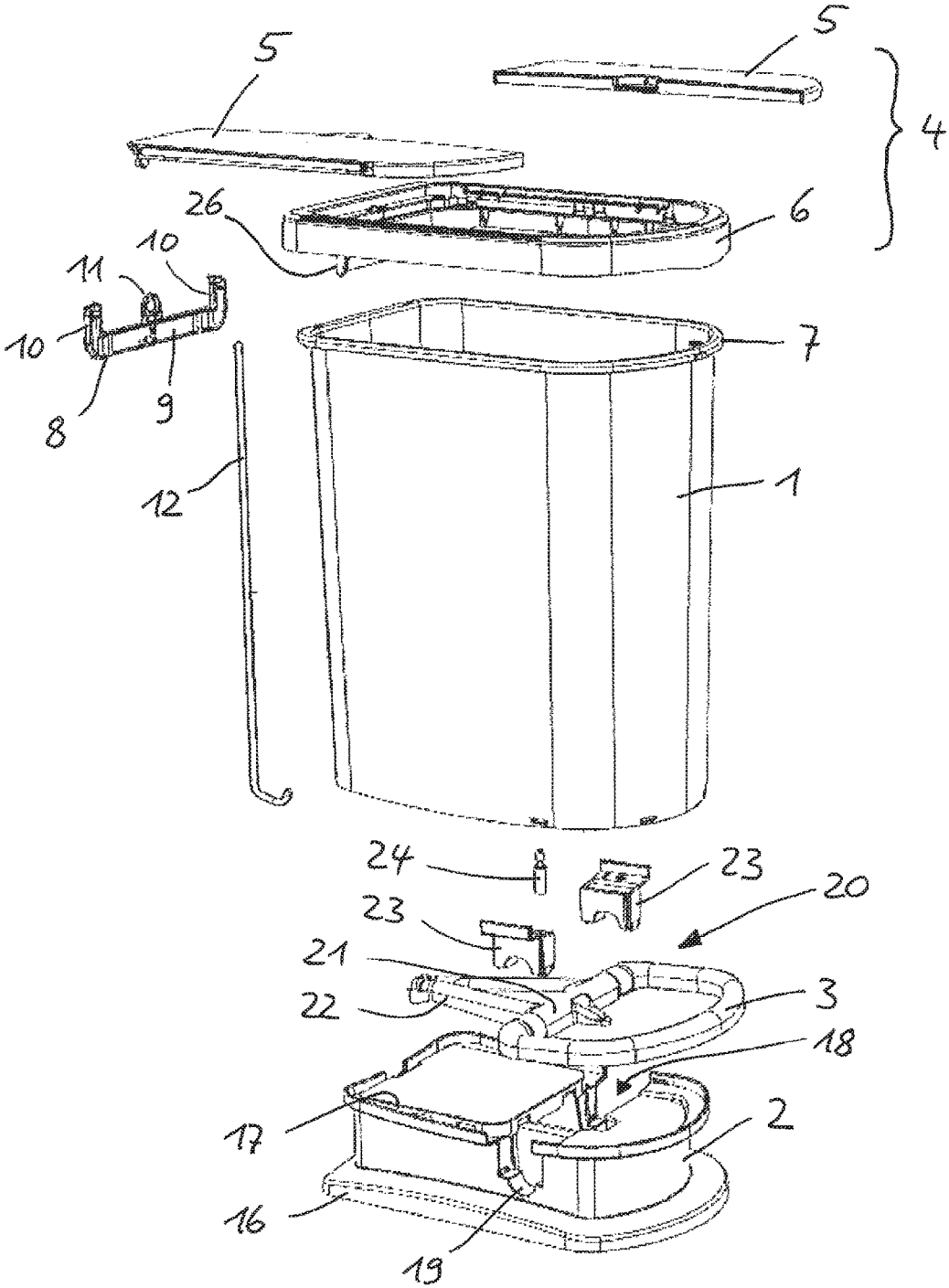
FIG. 5 an exploded illustration of the trash collector according to the previous figures.

FIG. 5 shows in an exploded illustration the individual parts of the trash collector of FIGS. 1 to 4, which except for the push rod 12 are made from injection-molded plastic. The base part 2 comprises at the bottom a base element 16 and at the top latching elements 17 for the bucket 1. Bearing seats 19 for the pedal 3 are provided in a recess 18, which is a part of the pedal lever 20. The pedal lever 20 has an axis 21, the pedal 3, and an actuating lever 22, in which the push rod 12 is inserted. The entire pedal lever 20 comprises an injection-molded part cast in one piece. Both hemispheres 23 of the bearing complete, together with the bearing seat 19, the bearing for the pedal lever 20. A damper element 24 acts upon the pedal lever 20, as explained in greater detail in the following.

The distribution element 8, the frame element 6, and the two lid sections 5 are provided at the top of the bucket 1. In the assembled state, the distribution element 8 rests on the push rod 12 and ensures via the two support arms 10 that during the operation of the pedal 3, which results in an upwards motion of the actuator lever 22 of the pedal lever 20 and thus to an upwards motion of the push rod 12, that the lid sections 5, which rest in the frame element 6 in a pivotal fashion, are pivoted open towards the top. The downwards motion of the push rod 12 is braked by the damper element 24, which acts upon the pedal lever 20 such that the lid sections 5 close in a cushioned fashion.

Figure 6A:
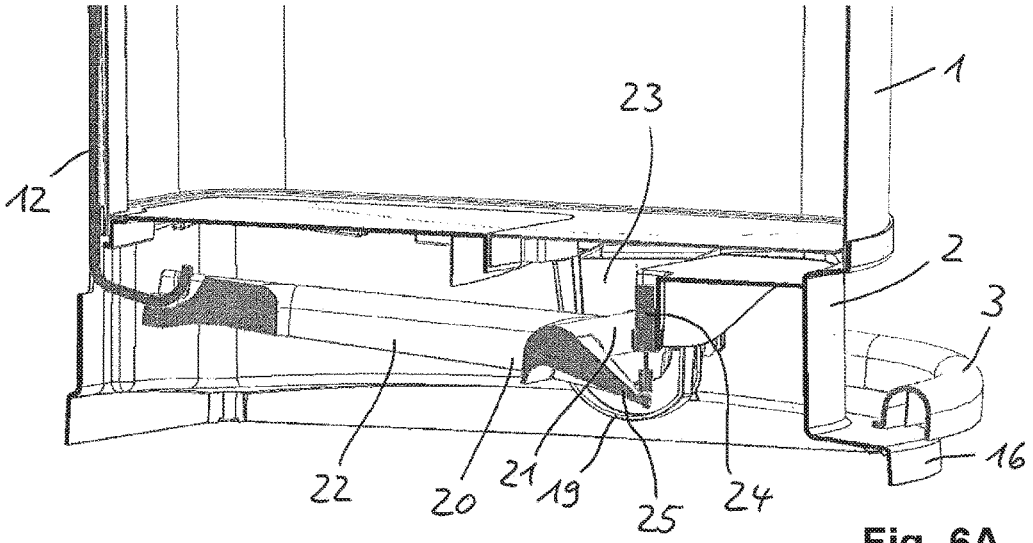
FIGS. 6A and 6B cross-sectional detail views of the bottom area of the trash collector of the previous figures.
Figure 6B:
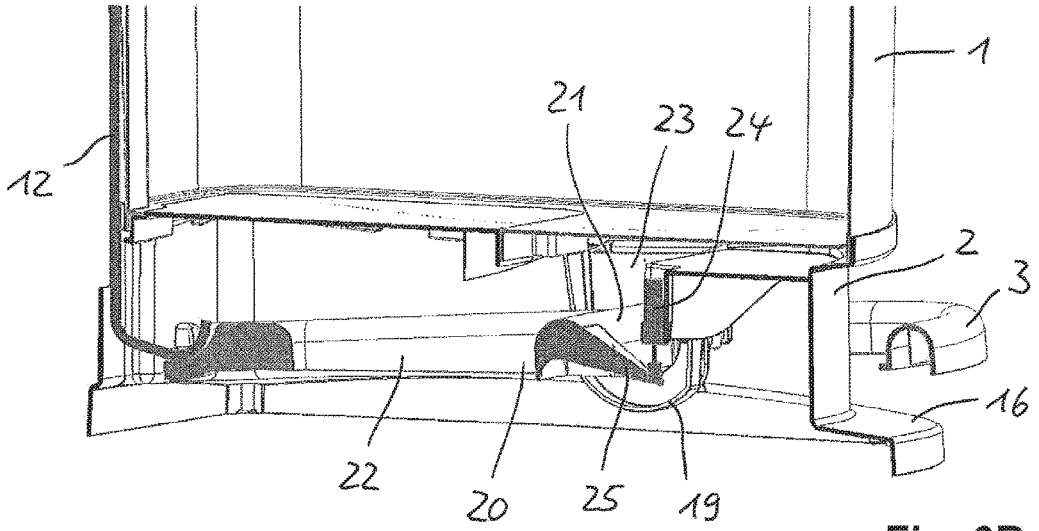

The functionality of the pedal lever 20 is illustrated in the cross-sections of FIGS. 6A and 6B. The pedal lever 20 with the pedal 3, actuator levers 22, and axis 21 are supported pivotally in the bearing seat 19 of the base part 2 and the hemispheres 23 of the bearing such that a downwards motion of the pedal 3 leads to an upwards motion of the actuator lever 22. The push rod 12 is inserted therein such that ultimately the push rod 12 is moved upwards when the pedal 3 is activated, i.e. moved downwards. This state is shown in FIG. 6A.

When the pedal 3 is released, the weight force of the push rod 12 and the lid ensures that the actuator lever 22 is moved back downwards such that the pedal 3 moves back upwards into the default position shown in FIG. 6B. During this motion a cam 25 of the pedal lever 20 approaches the damper element 24, which rests in the base part 2, causing the downwards motion of the actuator lever 22 and the push rod to be braked. After the release of the pedal 3 the lid sections 5 therefor drop not freely but in a cushioned fashion.

Figure 7:
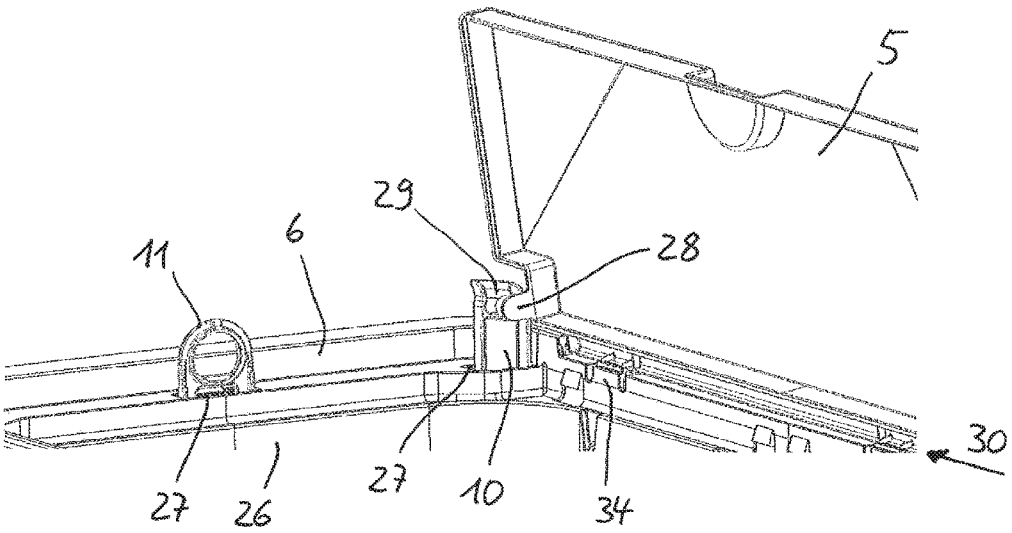
FIG. 7 an illustrated detail of an upper rear corner of the opened trash collector of the previous figures.

FIG. 7 shows a detail of the trash collector opened as in FIG. 2 in order to explain in greater detail the cooperation of the distribution element 8 with the lid sections 5. As shown in FIG. 3, the distribution element 8 rests inside the bucket 1, however the frame element 6 has a flare 26 extending into the bucket 1, which is also discernible in FIGS. 3 and 5, and which covers the distribution element 8 towards the inside. The support arms 10 of the distribution element 8, with only one being shown here, are guided via openings 27 through the frame element 6, which also applies for the handle 11. This way, the support arms 10 can act upon the lid sections 5 when the frame element 6 is placed upon the collar 7 of the bucket 1.

For this purpose the lid sections 5 each have a support element 28, which rests on a bearing site 29 of the support arm 10, open towards the top. Due to the fact that the bearing site 29 is open towards the top, the frame element 6 including the two lid sections 5, thus the entire lid 4, can be pivoted to the back (FIG. 3), with here the support element 28 lifting out of the bearing sites 29.

In order to compensate the different motion paths when the lid sections 5 are pivoted open, the support arm of the distribution element 8 moving vertically in a linear fashion, while the support element 28 of the lid sections 5 moving in a circular path about the pivotal axis 30 of the lid section 5, the bearing site 29 is embodied wider than the support element 28 so that a loose bearing forms, which allows a horizontal relative motion between the support element 28 and the support arm 10.

Figure 8:
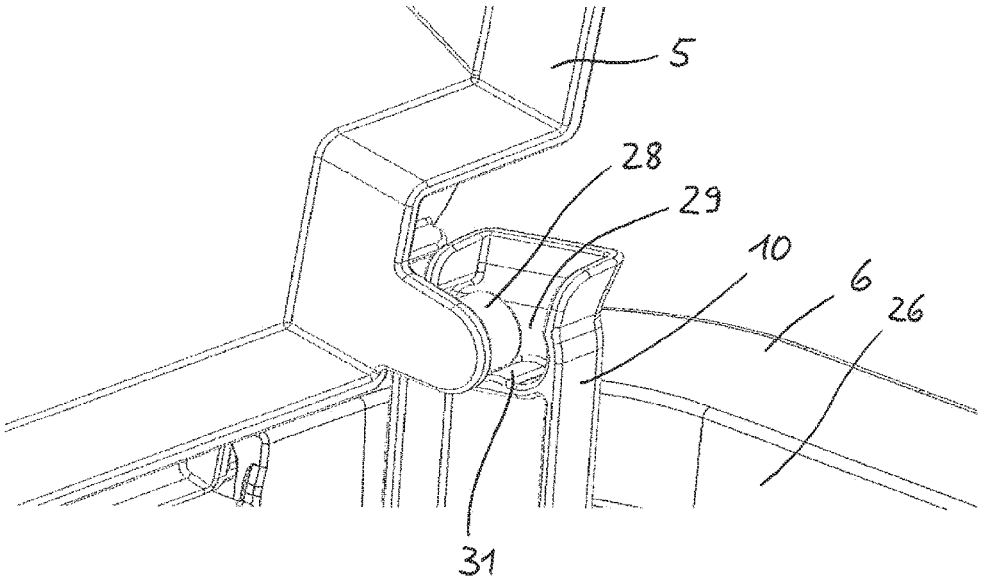
FIG. 8 an illustrated detail of another upper rear corner of the trash collector of the previous figures.

The other support arm 10 of the distribution element 8, shown in detail in FIG. 8, comprises a control area 31 which ensures that the pivotal motion of the lid section 5 is controlled such that it pivots open and shuts with a slight time lag and/or a slowed motion such that the two lid sections 5 are not pivoting open and shut at precisely the same time, but a slight off-set being given of these two motions, which optimizes the problem of air resistance both during opening as well as closing of the trash collector.

Figure 9:
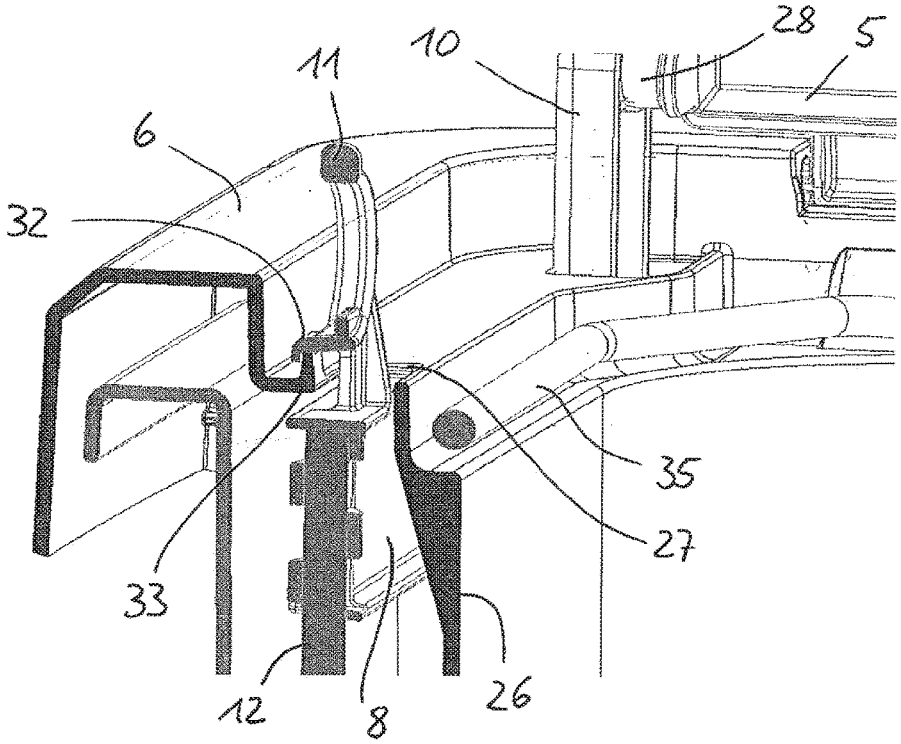
FIG. 9 a detail of FIG. 7 in a cross-section.

FIG. 9 shows the arrangement of FIG. 7 in a cross-section, in order to explain the existing locking option. Via the handle 11 of the distribution element 8, which is guided through an opening 27 in the frame element 6 and thus is accessible in spite of the flare 26, the distribution element 8 and with it the push rod 12 inserted into the distribution system 8 can be locked in the raised state such that the support arms 10 remain raised and the lid sections 5 are locked in the opened state.

For this purpose, a hook element 32 is formed at the handle 11, which can be suspended in a counter support 33 at the back of the trash collector, which is formed here at the frame element 6. FIG. 9 shows a situation in which the hook element 32 engages behind the counter support 33 and thus locks the distribution element 8 in the raised position. By a simple raising of the handle 11 this engagement can be released so that the distribution element 8 and the push rod 12 move back downwards in a cushioned fashion, causing the lid sections 5 to fold shut due to gravity.

Figure 10:
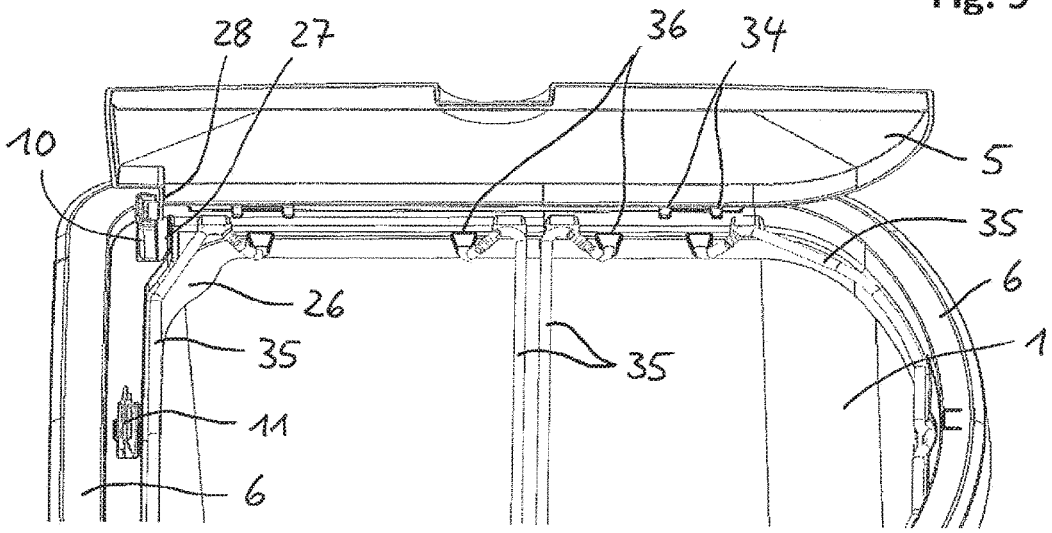
FIG. 10 a (partial) top view of the opened trash collector of the previous figures.

As discernible from FIG. 10, spring-elastic stop elements 34 are arranged at the frame element 6 in the area of the hinges of the lid sections 5, which ensure that when the support arms 10 are lowered, the lid sections 5 are pivoted inwardly at least to such an extent that they automatically pivot shut based on gravity. These stop elements 34 allow to pivot open the lid section 5 to such an extent that they would not automatically pivot shut simply based on gravity.

As additionally discernible from FIG. 10 the example illustrated here of the trash collector according to the invention finally shows four spring arms 35, by which a trash bag (not shown) in the bucket 1 can be fastened. These spring bars 35 rest detachably in recesses 36 in the frame element 6 and accordingly they can be pivoted towards the back together with the lid 4 and/or the frame element 6.

The invention claimed is:

1. A trash collector comprising:

a bucket (1) and a lid (4), which covers the bucket (1) and is fastened in an area of an upper brim of the bucket (1) in a pivotal fashion, in order to pivot open towards a top to open the trash collector, a pedal arrangement (3, 20) which is arranged in the area of a base of the bucket (1), a lever arrangement (8, 12) connecting the pedal arrangement (3, 20) to the lid (4) in order to pivot open the lid (4) by moving the pedal arrangement (3, 20), the lid (4) being embodied in several parts including at least two lid sections (5), each being pivotable about a separate axis (30, 30'), and a frame element (6), which is fastened in the area of the upper brim of the bucket (1) in at least one of a detachable or pivotal fashion, and to which the lid sections (5) are fastened in a pivotal fashion, the lever arrangement comprises a distribution element (8) for distributing a motion of the pedal arrangement (3, 20) to the individual lid sections (5), with the distribution element (8) comprising for each of the lid sections (5) a support arm (10) extending towards a top with a bearing site (29), open towards the top, to receive a support element (28) of the lid section (5), the lid (4) comprises the frame element (6) and two of the lid sections (5) fastened thereto in a pivotal fashion, the distribution element (8) comprises a lateral brace (9) and two of the support arms (10) extending upwards therefrom, provided the bearing sites (29) open towards the top for pivoting open the lid sections (5), the distribution element (8) is arranged in a rear upper section of the trash collector and is connected via a central push rod (12) to the pedal arrangement (3, 20), and a locking device for the distribution element (8) which fixes the support arms (10) in a raised position in order to prevent closing of the trash collector.

2. The trash collector according to claim 1, wherein at least one of the bearing sites (29) or the support elements (28) are provided with control areas (31), with respectively one of the support arms (10) and one of the support elements (28) moving along the control areas in reference to each other when the respective lid section (5) is pivoted.

3. The trash collector according to claim 1, wherein at least one of the lever arrangement (8, 12), the pedal arrangement (3, 20), or the lid (4) are provided with a damper element (24) to cushion a closing motion of the lid (4) or any pivoting shut of the lid sections (5) or both.

4. The trash collector according to claim 1, wherein the locking device comprises a handle (11) and a hook element (32) at the lateral brace (9), and the hook element (32) is suspendable on a counter support (33) at a back of the trash collector and disconnectable therefrom.

5. The trash collector according to claim 4, wherein the hook element (32) is suspended on the counter support (33) and disconnected therefrom by tipping the distribution element (8).

6. The trash collector according to claim 1, wherein spring-elastic stop elements (34) are arranged in an area of pivotal support of the lid sections (5) in order to at least pivot the opened lid sections (5), when the pedal (3) is not actuated, at least to such an extent that based on gravity the lid sections automatically pivot shut.

7. The trash collector according to claim 1, wherein the bucket (1) forms an exterior casing of the trash collector.

8. The trash collector according to claim 7, wherein the bucket (1) is provided at an upper brim thereof with a circumferential collar (7) and the frame element (8) is embodied as an annular fitting which rests on the collar (7) of the bucket (1).

9. The trash collector according to claim 8, wherein, for each of the lid sections (5) the distribution element (8) includes a support arm (10) extending towards a top with a bearing site (29), open towards the top, to receive a support element (28) of the lid section (5), the lid (4) comprises the frame element (6) and two of the lid sections (5) fastened thereto in a pivotal fashion, and the distribution element (8) comprises a lateral brace (9) and two of the support arms (10) extending upwards therefrom, provided the bearing sites (29) open towards the top for pivoting open the lid sections (5), the distribution element (8) is arranged in a rear upper section of the trash collector and is connected via a central push rod (12) to the pedal arrangement (3, 20), the push rod (12) extends in a groove (13) at a rear exterior of the bucket (1) and is guided through a penetration (14) in an area of the upper brim of the bucket (1) into an interior of the bucket (1), where the lateral brace (9) of the distribution element (8) is fastened at the push rod (12), and the frame element (6) is provided with a flare extending into the interior of the bucket (1), which at least covers the lateral brace (9) of the distribution element (8), and the frame element (6) includes openings (27) for the support arms (10) of the distribution element (8).

10. The trash collector according to claim 1, wherein in an area of the upper brim of the bucket (1) detachable spring bars (35) are provided for fixing an inserted trash bag.

* * * * *